US008100152B2

(12) United States Patent
De Antoni Migliorati

(10) Patent No.: US 8,100,152 B2
(45) Date of Patent: Jan. 24, 2012

(54) ROTATING FILLER FOR VISCOUS PRODUCT

(75) Inventor: Narciso De Antoni Migliorati, Castiglione Delle Stiviere (IT)

(73) Assignee: Weightpack S.R.L., Goito (IT)

( * ) Notice: Subject to any disclaimer, the term of this patent is extended or adjusted under 35 U.S.C. 154(b) by 1099 days.

(21) Appl. No.: 11/920,506

(22) PCT Filed: May 9, 2006

(86) PCT No.: PCT/EP2006/004324

§ 371 (c)(1), (2), (4) Date: Nov. 16, 2007

(87) PCT Pub. No.: WO2006/122676

PCT Pub. Date: Nov. 23, 2006

(65) Prior Publication Data

US 2009/0133777 A1 May 28, 2009

(30) Foreign Application Priority Data

May 20, 2005 (IT) ..... MN2005A0031

(51) Int. Cl.
*B65B 43/42* (2006.01)

(52) U.S. Cl. ..... 141/146; 141/82; 141/144; 141/145

(58) Field of Classification Search ..... 141/82, 141/144–148

See application file for complete search history.

(56) References Cited

U.S. PATENT DOCUMENTS

| | | | | |
|---|---|---|---|---|
| 3,097,672 | A * | 7/1963 | Minard | 141/142 |
| 3,138,178 | A * | 6/1964 | McK Martin | 141/82 |
| 3,430,639 | A | 3/1969 | Roberts | |
| 4,189,071 | A * | 2/1980 | West | 222/189.11 |
| 4,326,567 | A * | 4/1982 | Mistarz | 141/90 |
| 6,701,979 | B2 * | 3/2004 | Servadei et al. | 141/146 |
| 6,755,224 | B2 * | 6/2004 | Tawa et al. | 141/144 |

FOREIGN PATENT DOCUMENTS

| | | |
|---|---|---|
| EP | 0 568 121 A | 11/1993 |
| FR | 1 389 884 A | 2/1965 |
| FR | 2 067 499 A | 8/1971 |
| GB | 1 062 990 A | 3/1967 |
| GB | 1 233 818 A | 6/1971 |
| JP | 55-14277 | 1/1980 |
| JP | 02-176300 | 7/1990 |
| JP | 3041217 | 6/1997 |
| JP | 2001-041392 | 2/2001 |
| JP | 2001-072190 | 3/2001 |
| JP | 2002-048295 | 2/2002 |
| JP | 2003-065464 | 3/2003 |
| JP | 2004-210402 | 7/2004 |
| WO | WO 01/85594 A | 11/2001 |

* cited by examiner

*Primary Examiner* — Timothy L Maust

(74) *Attorney, Agent, or Firm* — Modiano & Associati; Albert Josif; Daniel O'Byrne

(57) ABSTRACT

A machine for filling containers with liquid product, comprising a rotating carousel provided with a plurality of filling stations, means adapted to provide selective feeding by means of a hot fluid and by means of the product, and means adapted to collect and evacuate the hot fluid that exits from the faucets, all the walls of the machine designed to be in contact with the hot fluid and the liquid product having high thermal insulation characteristics.

4 Claims, 2 Drawing Sheets

ROTATING FILLER FOR VISCOUS PRODUCT

The present invention relates to a machine for filling containers with liquid product.

BACKGROUND OF THE INVENTION

Machines for filling containers with liquid products are currently available which comprise a rotating carousel, which is provided with a plurality of filling stations, each whereof comprises a faucet for dispensing the product to a container supported in an underlying position, and is further provided with means which ensure the exact dosage of the product in the container, such as a load cell or a flowmeter.

Machines comprising a tank for containing the product, fitted on the rotating carousel and provided with dispensing faucets at the bottom, are very common, and there is also a different type of such machines in which the product is fed to the individual faucets by conveyance from a manifold which is located on board the carousel and in turn is fed by means of a line provided with a pump.

Certain products are fed hot into the filling machines and must not undergo temperature drops during flow through such machines, in order to avoid losing required organic and fluidity properties, as is the case for cheeses.

The background art currently does not have satisfactory solutions, and therefore the aim of the present invention is to provide a filling machine which ensures that the product that is introduced hot into such machine maintains its temperature.

SUMMARY OF THE INVENTION

This aim is achieved by a machine for filling containers with liquid product, according to the invention, comprising a rotating carousel provided with a plurality of filling stations, each whereof comprises means for supporting a container below a dispensing faucet, characterized in that it comprises means adapted to provide selective feeding by means of a hot fluid and by means of the product, and means adapted to collect and evacuate the hot fluid that exits from the faucets, all the walls of the machine designed to be in contact with said hot fluid and said liquid product having high thermal insulation characteristics.

BRIEF DESCRIPTION OF THE DRAWINGS

Further characteristics and advantages of the present invention will become better apparent from the description of a preferred but not exclusive embodiment thereof, illustrated by way of non-limiting example in the accompanying drawings, wherein.

DESCRIPTION OF THE PREFERRED EMBODIMENTS

Figure 1:
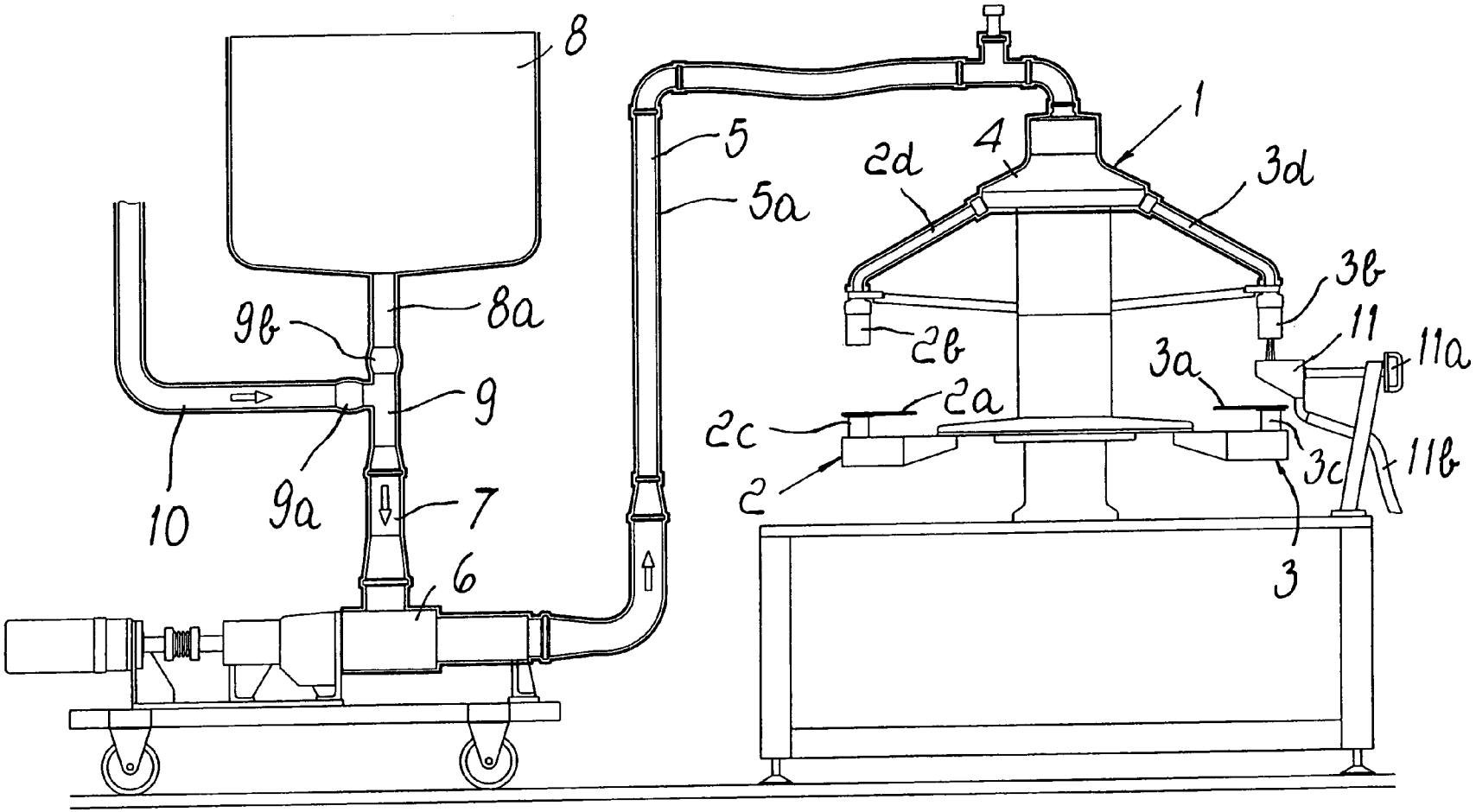
FIG. 1 is a schematic general view of the machine at the beginning of its operation, during the warm-up step.

With reference to the figures, the reference numeral 1 generally designates a rotating carousel of the machine, which supports a plurality of filling stations 2 and 3, each whereof comprises a pad for supporting a container 2*a*, 3*a*, which is located below a faucet for dispensing liquid 2*b*, 3*b* and is provided with a load cell 2*c*, 3*c*, which ensures the exact dosage of liquid into the container.

The dispensing faucets are fed by means of individual ducts 2*d*, 3*d*, which extend from a manifold 4 on board the carousel, which in turn is fed directly by means of a duct 5, which is connected to the delivery of the pump 6 which draws the liquid product by means of a duct 7 from the tank 8, in which such product is kept hot.

An important feature of the invention consists in that it comprises means adapted to feed the machine selectively, said means comprising a T-shaped connector designated by the reference numeral 9, which is fitted along the intake duct 7 of the pump 6 and is provided with two flow control valves 9*a*, 9*b*, which are connected respectively to a duct 10 for feeding hot fluid and to a duct 8*a* that originates from the tank 8 of hot liquid product.

The machine according to the invention is provided with means adapted to collect and evacuate the hot fluid flowing out of the faucets, which comprise a tray 11, which is designed to be moved, by manually actuating a handle 11*a*, between a position which lies below the faucets in a limited sector, shown in FIG. 1, and an external position, shown in FIG. 2.

All the walls of the machine that are designed to be in contact with the hot fluids have high thermal insulation characteristics, and therefore all the ducts are made of stainless steel covered with an insulating jacket 5*a* for the duct 5, while the faucets 2*b*, 3*b* are made of insulating plastic material; according to a different embodiment, the ducts also might be made of insulating plastic material.

Operation of the invention is as follows.

To ensure that the temperature of the liquid product to be sent to the containers be maintained, first of all, before starting the filling process, it is necessary to warm up the machine, and for this purpose, according to the configuration of FIG. 1, the valve 9*b* is kept closed and the valve 9*a* is kept open, so as to allow the hot fluid, such as for example hot water or steam, that arrives through the duct 10, to reach the machine.

The hot fluid flows through the entire machine, warming it up, and is discharged by means of the faucets 3*b*, which are located, during the motion of the carousel 1, in the sector that lies above the tray 11 within said tray, which provides evacuation by means of a tube 11*b*.

Figure 2:
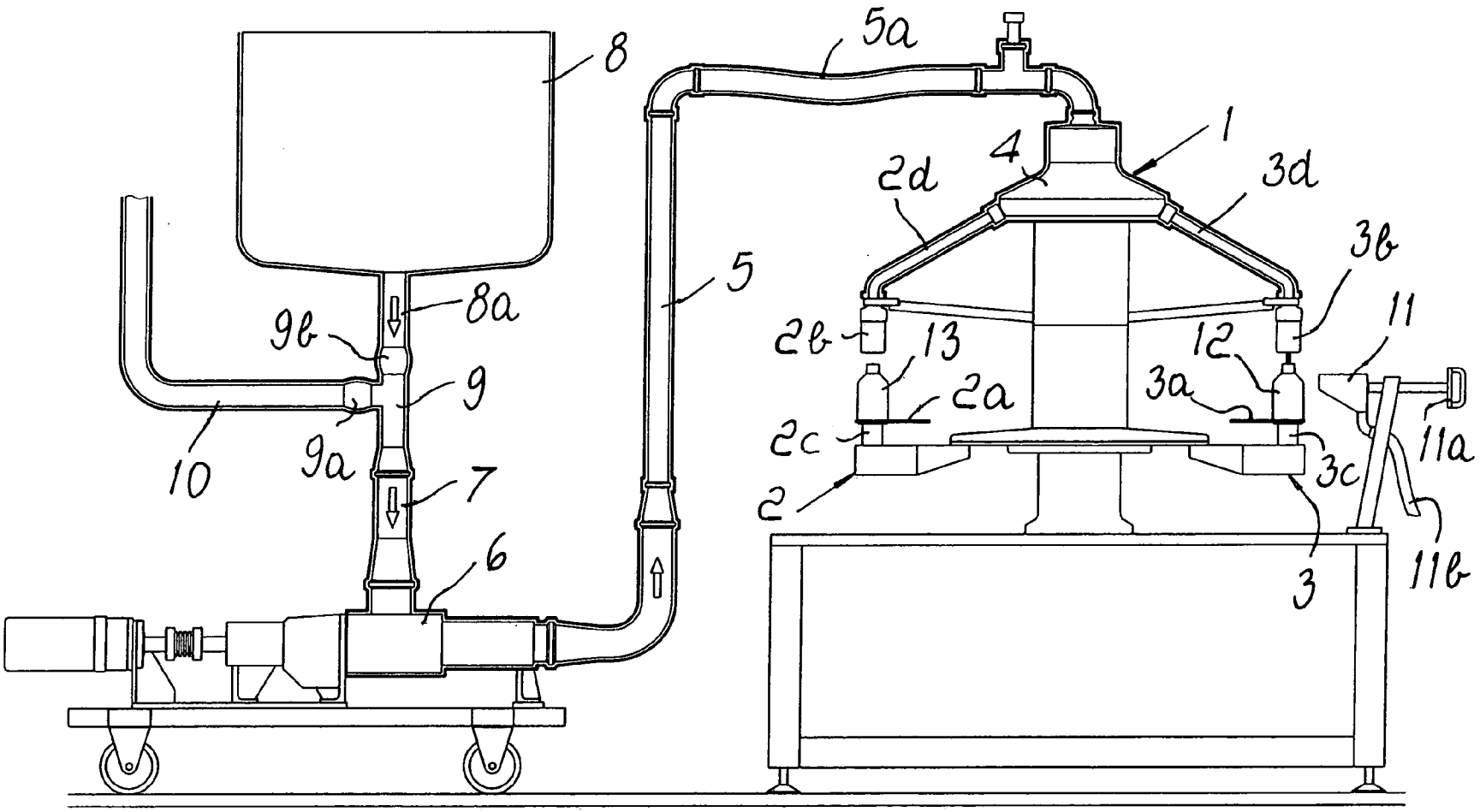
FIG. 2 is a view of the machine during normal operation.

At a certain point, the machine reaches the temperature selected to allow access of the hot liquid product, and therefore the configuration of FIG. 2 is assumed: after retracting the tray 11 and closing the valve 9*a*, the valve 9*b* is opened, and so the hot liquid product flows to the machine and reaches the containers 12 and 13, which in the meantime are made to flow toward the machine in order to achieve a normal filling operation.

The described invention is susceptible of numerous modifications and variations, all of which are within the scope of the appended claims; all the details may further be replaced with other technically equivalent elements.

The disclosures in Italian Patent Application No. MN2005A000031 from which this application claims priority are incorporated herein by reference.

What is claimed is:

1. A machine for filling containers with a heated liquid product, comprising: a rotating carousel provided with a plurality of filling stations, each whereof comprises means for supporting a container below a dispensing faucet; a pump having an input duct and an output feed duct which is connected between said pump and said rotating carousel; a source of heated water and a source of said heated liquid product; means for selectively feeding said heated water and said heated liquid product to said input duct of said pump such that said pump feeds a selected one of said heated water and said heated liquid product through said output feed duct to said rotating carousel; and means adapted to collect and evacuate the heated water that exits from the faucets when said heated water has been selected to be fed by said pump to said rotating carousel, all the walls of the machine designed to be in contact with said heated water and said heated liquid product having high thermal insulation characteristics.

2. The machine according to claim 1, wherein the means for evacuating the heated water that flows out of the faucets comprise a tray, which is provided with means for movement between a position which lies below said faucets and a position which is external with respect to said faucets.

3. The machine according to claim 1, wherein the walls of the machine designed to make contact with the heated water and with the heated liquid product are made of metallic material and are covered with an insulating jacket.

4. The machine according to claim 1, wherein the walls of the machine designed to make contact with the heated water and with the heated liquid product are made of insulating plastic material.

* * * * *